United States Patent [19]

Calhoun et al.

[11] Patent Number: 4,487,316

[45] Date of Patent: Dec. 11, 1984

[54] ELEVATOR HOLDER FOR PERM RODS

[76] Inventors: Tom L. Calhoun; Bill L. Calhoun, both of P.O. Box 447, Buttonwillow, Calif. 93206

[21] Appl. No.: 514,141

[22] Filed: Jul. 14, 1983

[51] Int. Cl.[3] ..... B65D 85/20; B65D 85/62; B65D 83/02

[52] U.S. Cl. ..... 206/443; 206/45.16; 206/507; 206/804; 211/60 R; 220/93; 312/73

[58] Field of Search ..... 206/443, 507, 214, 804, 206/45.16; 220/93; 217/19; 211/60 R; 312/73

[56] References Cited

U.S. PATENT DOCUMENTS

| | | | |
|---|---|---|---|
| 1,678,260 | 7/1928 | Martino et al. | 220/93 |
| 1,758,168 | 5/1930 | Olivaux | 312/73 |
| 2,487,107 | 11/1949 | D'Andrea | 312/73 |
| 4,136,773 | 1/1979 | Booth | 206/214 |

*Primary Examiner*—William T. Dixson, Jr.
*Attorney, Agent, or Firm*—Harvey B. Jacobson

[57] ABSTRACT

A hollow housing is provided including a top wall having a plurality of horizontally spaced openings formed therein and each of the openings has a depending cylindrical wall structure operatively associated therewith and supported from the top wall. The lower ends of the cylindrical wall structures include diametric slots formed therein and perm rod support and elevator structure in the form of a grid structure is mounted within the housing with various grid bars thereof extending through and vertically shiftable in the cylindrical wall structure diametric slots. The grid bars form vertically shiftable floor portions for the cavities defined by the top wall openings and the cylindrical wall structures dependingly supported from the top wall. Vertically disposed perm rods are downwardly receivable within the aforementioned cavities and have their lower ends abutted against and supported from the grid bars. When the support and elevator structure is in its lowest position the upper ends of the perm rods are recessed downwardly below the openings and when the support and elevator structure is in its uppermost position the perm rods are supported with substantial portions of the upper ends thereof projecting upwardly and outwardly through the openings formed in the top wall of the housing. In addition, structure is provided for raising and lowering the elevator structure from above the housing and for releasably latching the support and elevator structure in its uppermost position.

3 Claims, 5 Drawing Figures

FIG. 1
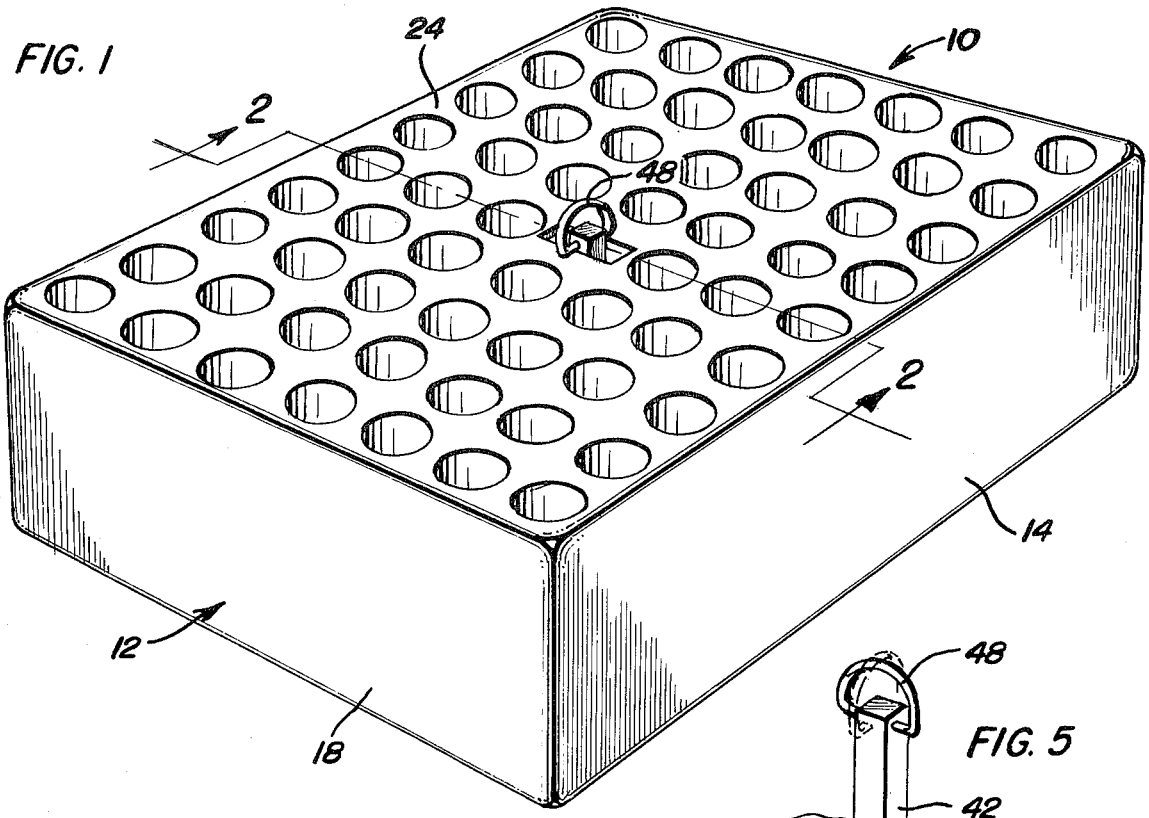
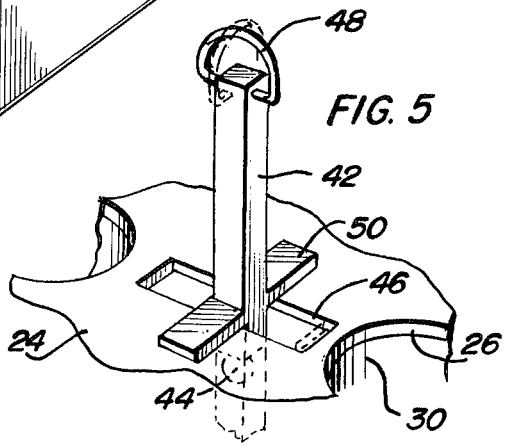
FIG. 5
FIG. 2
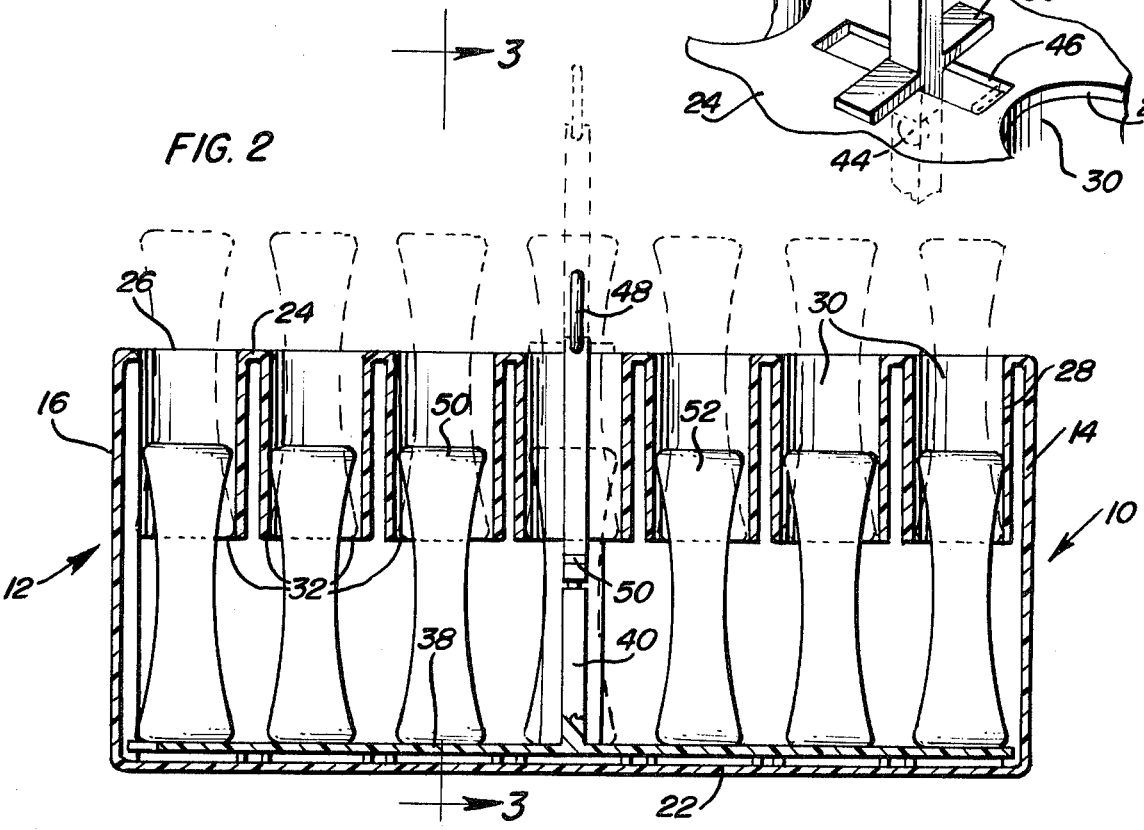

ELEVATOR HOLDER FOR PERM RODS

BACKGROUND OF THE INVENTION

In beauty salons approximately 50 to 60 perm rods are used to set a woman's hair. When the perm rods are removed from a woman's hair they are usually deposited into a basin or sink and are subsequently washed prior to reuse. However, after the perm rods are washed and rinsed, no convenient receptacle is available for storage of the perm rods before the next usage thereof. Accordingly, a need exists for a holder in which washed and rinsed perm rods may be stored prior to subsequent usage. In addition, a need for a perm rod holder also exists constructed in a manner whereby the holder will support the perm rods in a manner whereby access to the perm rods, in succession, may be had when rolling a woman's hair.

Examples of various different forms of holders including some of the general structural and operational features of the instant invention are disclosed in U.S. Pat. Nos. 2,586,820, 3,473,004 and 3,519,793.

BRIEF DESCRIPTION OF THE INVENTION

The perm rod holder of the instant invention comprises a rectangular housing of hollow construction and including a top wall having a plurality of openings formed therethrough. Cylindrical receivers or wall structures depend downwardly from the top wall about the openings formed therein and the lower ends of the receivers are equipped with diametric slots. A support and elevator structure in the form of a grid is provided and mounted within the housing for vertical shifting therein. The grid includes grid bars which extend through the diametric slots formed in the receivers and upon which the lower ends of associated perm rods may abut for support. When the support and elevator structure is disposed in its lower position the perm rods supported therefrom are recessed downwardly below the top wall of the housing. However, when the support and elevator structure is raised to and latched in its upper position, the upper end portions of the supported perm rods project upwardly through the openings formed in the top wall of the housing whereby the upper ends of successive perm rods may be readily gripped for removal from the holder or housing.

The main object of this invention is to provide a holder in which a plurality of perm rods may be conveniently stored after having been washed and rinsed subsequent to each usage thereof and preparatory to the next usage thereof.

Another object of this invention is to provide a holder in which perm rods may be stored in an unobtrusive manner.

Still another object of this invention is to provide a perm rod holder constructed in a manner whereby the plurality of perm rods supported therefrom may be elevated to exposed positions enabling ready access thereto for successive placement in a woman's hair.

A final object of this invention to be specifically enumerated herein is to provide a perm rod holder in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the perm rod holder with the support and elevator structure thereof in its lower position;

FIG. 2 is an enlarged fragmentary vertical sectional view taken substantially upon the plane indicated by the section line 2—2 of FIG. 1;

FIG. 5 is a fragmentary perspective view of the central portion of the top wall of the holder and illustrating the manner in which the lift bar for the support and elevator structure may be rotated to releasably retain the support and elevator structure in its upper position.

DETAILED DESCRIPTION OF THE INVENTION

Figure 3:
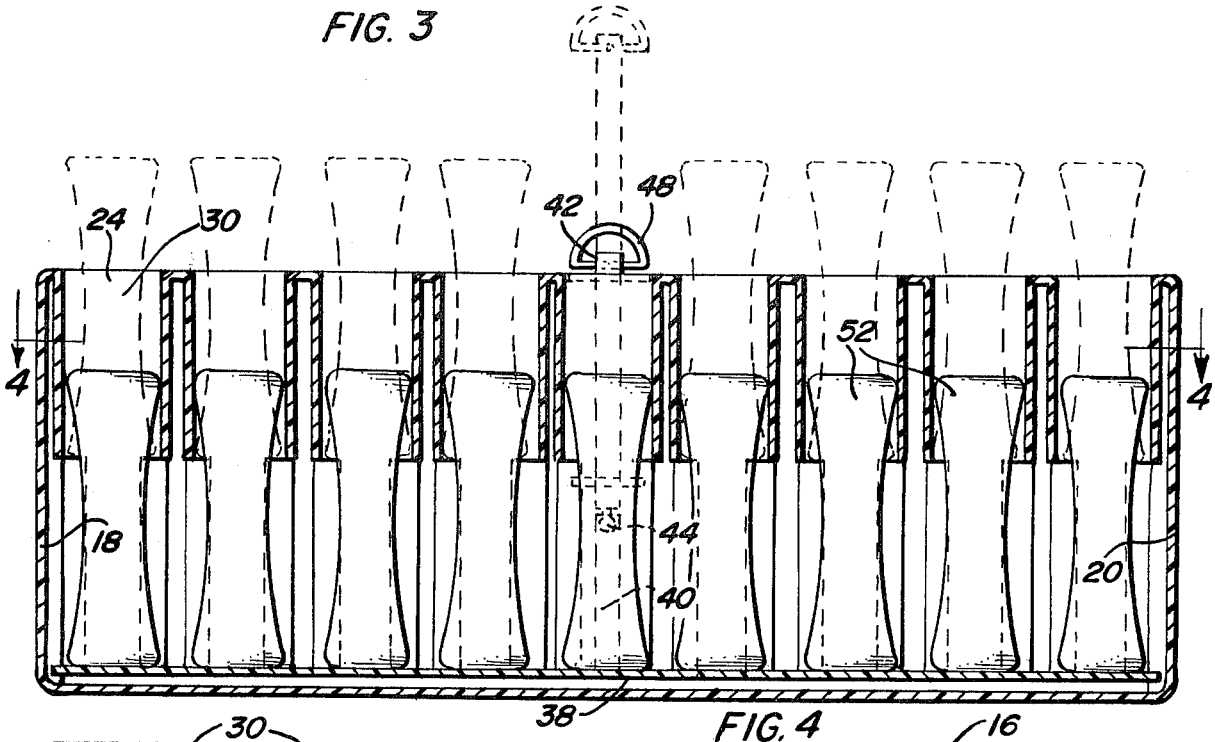
FIG. 3 is a vertical sectional view taken substantially upon the plane indicated by the section line 3—3 of FIG. 2.
Figure 4:
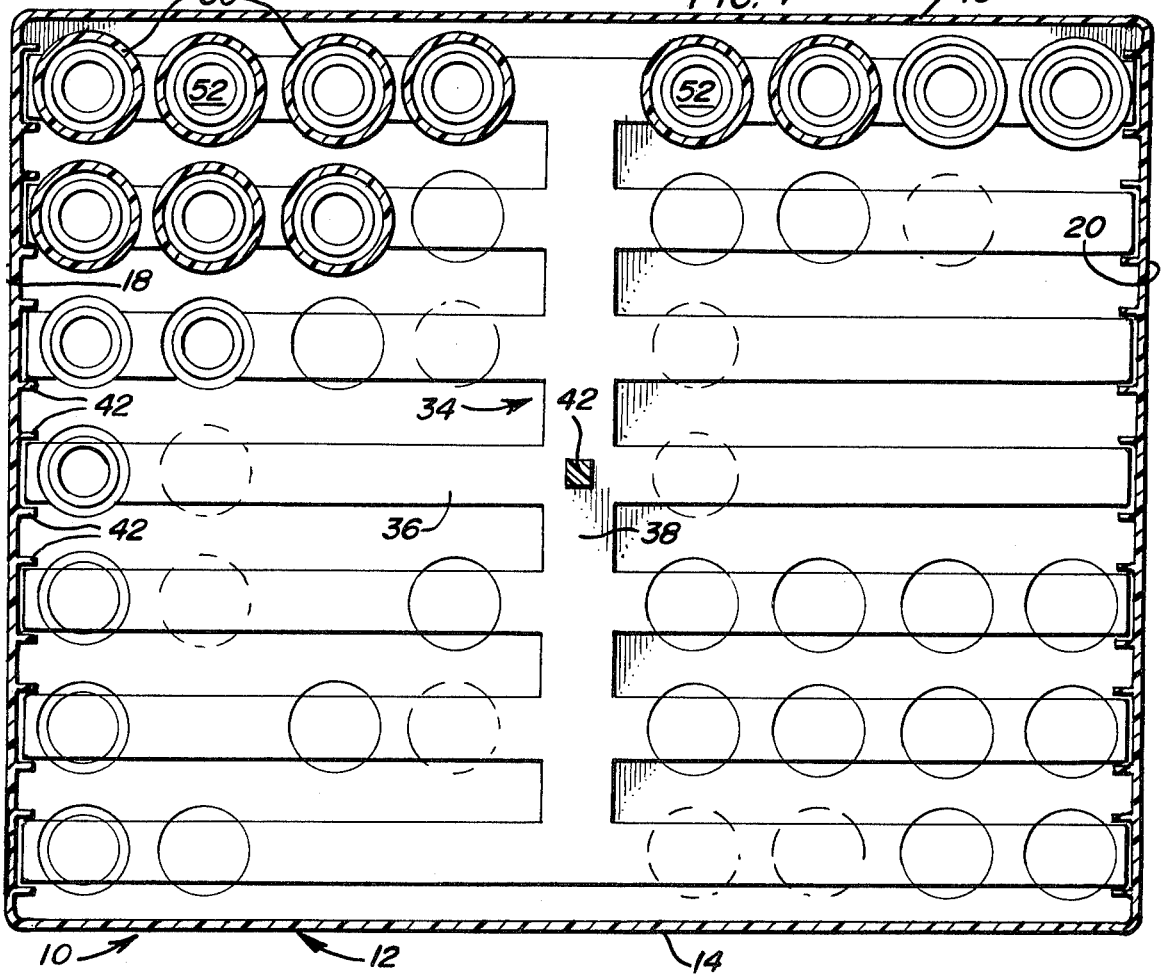
FIG. 4 is a horizontal sectional view taken substantially upon the plane indicated by the section line 4—4 of FIG. 3.

Referring now more specifically to the drawings, the numeral 10 generally designates the perm rod holder of the instant invention. The perm rod holder 10 includes a housing of generally rectangular configuration and referred to in general by the reference numeral 12. The housing 12 includes opposite side walls 14 and 16 as well as opposite end walls 18 and 20 projecting upwardly from a bottom wall 22. In addition, the upper marginal portions of the walls 14, 16, 18 and 20 are interconnected by a top wall 24 extending therebetween and the top wall 24 includes a plurality of openings 26 formed therethrough. A generally cylindrical receiver 28 is supported from the top wall 24 about each opening 26 and depends downwardly from the top wall 24. The receivers 28 define perm rod receiving cavities 30 therein opening upwardly through the openings 26 and the lower ends of the receivers 28 include diametric slots 32.

A support and elevator structure referred to in general by the reference numeral 34 is provided and is in the form of a grid including parallel grid bars 36 interconnected by a connecting bar 38 upwardly from which a central shank portion 40 projects. The support and elevator structure 34 is snugly received within confines of the walls 14, 16, 18 and 20 and the free ends of the grid bars 36 are slidably received between adjacent inwardly projecting flanges 42 carried by and projecting inwardly from the inner sides of the walls 18 and 20.

The upper end of the shank portion 40 has a shank portion extension 42 rotatably supported therefrom as at 44 and the upper end of the shank portion extension 42 is slidably received through a central slot 46 formed in the top wall 24. In addition, the upper terminal end of the extension 42 includes a support ring 48 by which a manual grip may be applied to the extension 42 for lifting the latter. The lower end of the extension 42 includes a crossbar 50 which may be passed vertically through the slot 46 when the extension 42 is rotated to a position with the bar 50 extending lengthwise of the slot 46. In addition, the extension 42 may be rotated 90° to the position thereof illustrated in FIG. 5 of the drawings with the bar 50 spaced above the top wall 24 in order that the bar 50 may bridge the slot 46 and support the weight of the extension 42, the shank portion 40, the elevator structure 34 and associated perm rods 52 downwardly abutted against the grid bars 36 from the upper or top wall 24 of the housing 12.

In operation, after a plurality of perm rods 52 have been washed and rinsed subsequent to their usage, the perm rods 52 are downwardly inserted through the openings 26 and allowed to drop into the receivers 28 for support from the grid bars 36. After all of the perm rods 52 have been placed in position within the receivers 28, the support ring 48 may be grasped and the extension 42 may be rotated to a position with the crossbar 50 extending longitudinally of the slot 46 for downward reception therethrough. Lowering the extension 42 relative to the top wall 24 lowers the support and elevator structure 34 to its lowermost position such as that illustrated in FIGS. 2 and 3 of the drawings with the upper ends of the perm rods 52 recessed below the openings 26. At this point the vertical height of the housing 12 is reduced to a minimum and the housing 12 may be placed upon a shelf until it is desired to again use the perm rods 52.

Upon removal of the housing 12 from an associated storage shelf, the ring 48 may be grasped and elevated in order to elevate the support and elevator structure 34. After the crossbar 50 has passed upward through the slot 46, the extension 42 may be rotated 90° in order to position the crossbar 50 transverse to the slot 46. Thereafter, the support ring 48 may be lowered in order that the support bar 50 may downwardly abut and be supported from the upper surface of the top or upper wall 24. In this position, the support and elevator structure 34 is disposed at an elevation with the upper ends of the perm rods 52 projecting above the top wall 24 in the positions thereof illustrated in phantom lines in FIGS. 2 and 3 of the drawings. When thus positioned the upper ends of the perm rods 52 may be readily grasped by a beautician preparatory for placing the perm rods in a woman's hair.

It is also to be noted that the bottom wall 22 may be provided with performations (not shown) to enable used perm rods to be received within the holder 10 and thereafter washed while supported within the holder 10. Therefore, after the perm rods have been placed within the holder 10 as they are removed from a customer's hair, they need not be removed from the holder 10 until they are to be used on the next customer's hair.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a plurality of elongated perm rods, a holder for said perm rods, said holder including body means defining a plurality of upwardly opening cavities downwardly into which said perm rods are lengthwise received, support and elevator structure mounted from said body means below said openings for vertical shifting relative to said body means between upper and lower limit positions, said support and elevator structure including portions thereof defining vertically shiftable floor portions for said cavities against which the lower ends of said perm rods are abutted for support within said cavities, said perm rods including upper ends projecting upwardly outwardly from the upper ends of said cavities when said support and elevator structure is in said upper position and which are at least substantially recessed downwardly within said cavities when said elevator structure is in said lower position, said body means comprising a hollow housing including a top wall and a plurality of open bottom upwardly opening receivers supported from said top wall and opening upwardly therethrough, said receivers including lower end transverse slots disposed within said housing below said top wall, said support and elevator structure comprising a grid including parallel grip bars upwardly slidably receivable within said slots and abuttable against those portions of said receivers defining the upper limits of said slots to define said upper limit position, said top wall including a central opening, said grid including a central upstanding shank portion aligned with said opening, the upper end portion of said shank portion including an upward extension supported therefrom for angular displacement about an upstanding axis, said extension being slidably received through said central opening, said extension including a lower end crossbar, said central opening comprising an elongated slot through which said crossbar is receivable when said crossbar extends lengthwise of said slot and said support and elevator structure is in said upper limit position, said extension being rotatable to a position with said crossbar disposed transverse to said slot when said crossbar is spaced above said top wall.

2. The holder of claim 1 wherein said receivers comprise cylindrical members and said transverse slots comprise diametric slots.

3. The holder of claim 2 wherein said cylindrical members include upper end portions supported from said top wall in registry with said openings.

* * * * *